US009850722B2

(12) United States Patent
Logan et al.

(10) Patent No.: US 9,850,722 B2
(45) Date of Patent: Dec. 26, 2017

(54) UNIVERSAL DOWNHOLE PROBE SYSTEM

(71) Applicant: Evolution Engineering Inc., Calgary (CA)

(72) Inventors: Aaron W. Logan, Calgary (CA); Justin C. Logan, Calgary (CA); David A. Switzer, Calgary (CA); Patrick R. Derkacz, Calgary (CA)

(73) Assignee: Evolution Engineering Inc., Calgary, CA (US)

( * ) Notice: Subject to any disclaimer, the term of this patent is extended or adjusted under 35 U.S.C. 154(b) by 260 days.

(21) Appl. No.: 14/441,131

(22) PCT Filed: Dec. 3, 2012

(86) PCT No.: PCT/CA2012/050871

§ 371 (c)(1),
(2) Date: May 6, 2015

(87) PCT Pub. No.: WO2014/071494

PCT Pub. Date: May 15, 2014

(65) Prior Publication Data

US 2015/0300099 A1 Oct. 22, 2015

Related U.S. Application Data

(60) Provisional application No. 61/723,287, filed on Nov. 6, 2012.

(51) Int. Cl.
*E21B 17/16* (2006.01)
*E21B 47/01* (2012.01)
(Continued)

(52) U.S. Cl.
CPC ..... *E21B 17/1078* (2013.01); *E21B 7/00* (2013.01); *E21B 17/00* (2013.01); *E21B 17/16* (2013.01);
(Continued)

(58) Field of Classification Search
CPC ..... E21B 17/1078; E21B 17/00; E21B 47/00; E21B 47/01; E21B 23/02; E21B 47/122;
(Continued)

(56) References Cited

U.S. PATENT DOCUMENTS 3,323,327 A 6/1967 Leathers et al.
3,982,431 A 9/1976 Grosso et al.
(Continued)

FOREIGN PATENT DOCUMENTS

CN 102359350 A 2/2012
CN 102725475 A 10/2012
(Continued)

*Primary Examiner* — Brad Harcourt
(74) *Attorney, Agent, or Firm* — Oyen Wiggs Green & Mutala LLP

(57) ABSTRACT

A downhole probe is adapted to be supported in drill string sections having different internal diameters with the use of a set of interchangeable centralizers. Each centralizer is dimensioned to snugly receive the downhole probe and to bear against the bore wall of a drill-string section. Interchangeable axial supports such as spiders may also be provided in a set. The downhole probe may comprise a slick body. As drilling progresses the downhole probe may be adapted to be received in drill string sections of varying diameters.

38 Claims, 9 Drawing Sheets

(51) Int. Cl.

| | |
|---|---|
| ***E21B 17/10*** | (2006.01) |
| ***E21B 23/01*** | (2006.01) |
| ***E21B 23/02*** | (2006.01) |
| ***E21B 47/00*** | (2012.01) |
| ***E21B 7/00*** | (2006.01) |
| ***E21B 47/12*** | (2012.01) |
| ***E21B 17/00*** | (2006.01) |
| *E21B 47/18* | (2012.01) |

(52) U.S. Cl.
CPC ..... *E21B 23/01* (2013.01); *E21B 23/02* (2013.01); *E21B 47/00* (2013.01); *E21B 47/01* (2013.01); *E21B 47/011* (2013.01); *E21B 47/122* (2013.01); *E21B 17/003* (2013.01); *E21B 47/123* (2013.01); *E21B 47/18* (2013.01)

(58) Field of Classification Search
CPC . E21B 23/01; E21B 17/16; E21B 7/00; E21B 47/011; E21B 47/123; E21B 17/003; E21B 47/18
See application file for complete search history.

(56) References Cited

U.S. PATENT DOCUMENTS

| | | | |
|---|---|---|---|
| 4,013,945 | A | 3/1977 | Grosso |
| 4,021,774 | A | 5/1977 | Asmundsson et al. |
| 4,216,536 | A | 8/1980 | More |
| 4,351,116 | A | 9/1982 | Scott, Jr. |
| 4,468,762 | A | 8/1984 | Jurgens |
| 4,537,067 | A | 8/1985 | Sharp et al. |
| 4,571,215 | A | 2/1986 | Hansen |
| 4,684,946 | A | 8/1987 | Issenmann |
| 4,734,893 | A | 3/1988 | Claycomb |
| 4,862,425 | A | 8/1989 | Cretin et al. |
| 4,901,289 | A | 2/1990 | Cretin et al. |
| 4,938,299 | A | 7/1990 | Jelsma |
| 5,064,006 | A | 11/1991 | Waters et al. |
| 5,160,925 | A | 11/1992 | Dailey et al. |
| 5,236,048 | A | 8/1993 | Skinner et al. |
| 5,247,990 | A | 9/1993 | Sudol et al. |
| 5,294,923 | A | 3/1994 | Juergens et al. |
| 5,333,686 | A | 8/1994 | Vaughan et al. |
| 5,474,132 | A | 12/1995 | Gallagher |
| 5,520,246 | A | 5/1996 | Van Steenwyk et al. |
| 5,590,714 | A | 1/1997 | Van Steenwyk et al. |
| 5,795,991 | A | 8/1998 | Hesse et al. |
| 5,803,193 | A | 9/1998 | Krueger et al. |
| 5,934,378 | A | 8/1999 | Tchakarov |
| 6,143,988 | A | 11/2000 | Neuroth et al. |
| 6,429,653 | B1 | 8/2002 | Kruspe et al. |
| 6,446,736 | B1 | 9/2002 | Kruspe et al. |
| 6,750,783 | B2 | 6/2004 | Rodney |
| 6,761,230 | B2 | 7/2004 | Cross et al. |
| 7,151,466 | B2 | 12/2006 | Gabelmann et al. |
| 7,243,028 | B2 | 7/2007 | Young et al. |
| 7,377,325 | B2 | 5/2008 | Trinder et al. |
| 7,604,059 | B2 | 10/2009 | Thornton |
| 8,020,634 | B2 | 9/2011 | Utter et al. |
| 8,201,645 | B2 | 6/2012 | Hall et al. |
| D665,824 | S | 8/2012 | Andrigo et al. |
| 8,251,160 | B2 | 8/2012 | Gopalan et al. |
| 8,284,073 | B2 | 10/2012 | Mehta et al. |
| 8,474,548 | B1 | 7/2013 | Young et al. |
| 2003/0164240 | A1 | 9/2003 | Vinegar et al. |
| 2005/0084337 | A1* | 4/2005 | Caldwell ..... E21B 17/017 405/224.2 |
| 2005/0217898 | A1 | 10/2005 | Clark |
| 2006/0202852 | A1 | 9/2006 | Peter et al. |
| 2007/0235224 | A1 | 10/2007 | Koger |
| 2008/0245570 | A1 | 10/2008 | Partouche |
| 2008/0314585 | A1 | 12/2008 | Clark |
| 2009/0023502 | A1 | 1/2009 | Koger |
| 2009/0267790 | A1 | 10/2009 | Hall et al. |
| 2010/0071960 | A1 | 3/2010 | Curry et al. |
| 2011/0138903 | A1 | 6/2011 | Large et al. |
| 2012/0247198 | A1* | 10/2012 | Durbec ..... G01V 1/40 73/152.02 |
| 2013/0133882 | A1 | 5/2013 | Harms et al. |

FOREIGN PATENT DOCUMENTS

| | | | |
|---|---|---|---|
| EP | 1248896 | B1 | 4/2006 |
| FR | 1303414 | A | 9/1962 |
| GB | 2253428 | A | 9/1992 |
| GB | 2406347 | A | 3/2005 |
| WO | 2006083764 | A1 | 8/2006 |
| WO | 2008116077 | A2 | 9/2008 |
| WO | 2011094429 | A2 | 8/2011 |
| WO | 2012045698 | A1 | 4/2012 |
| WO | 2012082748 | A2 | 6/2012 |

* cited by examiner

UNIVERSAL DOWNHOLE PROBE SYSTEM

TECHNICAL FIELD

This application relates to subsurface drilling, specifically to downhole probe systems. Downhole probes may be used, for example, in measurement-while-drilling (MWD) and logging-while-drilling (LWD). Embodiments are applicable to drilling wells for recovering hydrocarbons.

BACKGROUND

Recovering hydrocarbons from subterranean zones relies on drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid usually in the form of a drilling "mud" is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Modern drilling systems make use of downhole probes. Downhole probes may comprise any active mechanical, electronic, and/or electromechanical system that operates downhole. A probe may provide any of a wide range of functions including, without limitation, data acquisition; sensing; data telemetry; control of downhole equipment; status monitoring for downhole equipment; collecting data by way of sensors (e.g. sensors for use in well logging) that may include one or more of vibration sensors, magnetometers, nuclear particle detectors, electromagnetic detectors, acoustic detectors, and others; emitting signals, particles or fields for detection by other devices; sampling downhole fluids; etc. Some downhole probes are highly specialized and expensive.

Downhole conditions can be harsh. Exposure to these harsh conditions, which can include high temperatures, vibrations, shocks, and immersion in various drilling fluids at high pressures can shorten the lifespan of downhole probes. Supporting and protecting downhole probes is important as a downhole probe may be subjected to high pressures (20,000 p.s.i. or more in some cases), along with severe shocks and vibrations. Replacing a downhole probe that fails while drilling can involve very great expense.

It is common to drill different sections of a wellbore using different-diameter drill bits. For example, the section of a wellbore closest to the surface may be drilled with a larger-diameter bit. The next part of the wellbore may be drilled with a smaller bit. The deepest part of the wellbore may be drilled with a still smaller bit.

Downhole probes as are used, for example, in directional drilling applications, measuring while drilling (MWD) applications, and/or logging while drilling (LWD) applications may be provided with centralizing fins intended to keep the probes centralized in the bore of the drill string. Where such a probe is used in drill string sections having bores of different diameters the fins may not always support the probe well with the result that the probe may suffer damaging vibration or impact with the drill string.

One solution to this is to change the centralizers when it is desired to use the probe in a different diameter of drill string. However, a probe may include several centralizers. Changing the centralizers can be labor-intensive, costly, and may require dismantling of the probe or parts of it. Dismantling the probe at the well site can lead to reliability issues.

In some prior probes centralizers comprise fins that can be trimmed to fit into drill string sections of smaller diameters. Trimming the fins is often done with a knife. This can be dangerous and also results in inaccurate sizing of the centralizer to the drill string section it is supposed to fit. Inaccurate sizing can, in turn, result in damage to the probe.

Some drill collars include inwardly-projecting centralizing features designed to protect downhole probes. For example, U.S. Pat. No. 5,520,246 discloses apparatus for protecting instrumentation placed within a drill string. The apparatus includes multiple elastomeric pads spaced about a longitudinal axis and protruding in directions radially to the axis. US 2005/0217898 describes a drill collar having a longitudinal axis and an inner surface facing the longitudinal axis. Multiple elongate ribs are mounted to the inner surface and extend parallel to the longitudinal axis.

Since well drilling can be exceedingly expensive, it may be required to have at the well site a spare probe and a spare set of drill collars to support the probe. This can represent an undesirably large capital outlay and also large costs for transporting the probes and associated sets of collars to the well site. Some probes are 15 meters long or more. Drill collars of 11 inches or more in diameter are not uncommon.

There is a need for a better way to provide downhole probes for use in drill strings especially where it is desired to use the same probe in drill string sections of different diameters.

SUMMARY

The invention has several aspects. One aspect provides systems for adapting downhole probes for use in drill string sections of different sizes. One aspect provides drilling methods in which a downhole probe is supported for use in drill string sections of different sizes as drilling progresses.

Embodiments according to one aspect provide methods for drilling wellbores. The methods comprise inserting into a first drill string section having a bore of a first diameter a first centralizer and a downhole probe. In some embodiments the centralizer is inserted into the drill string section and the downhole probe is then inserted into the centralizer. In other embodiments the downhole probe is inserted into the centralizer and the downhole probe and centralizer are together inserted into the drill string section. The first centralizer extends between a wall of the bore of the first drill string section and the downhole probe and thereby mechanically couples the downhole probe to the first drill string section. The first centralizer supports the downhole probe centralized in the first drill string section. The first drill string section can then be coupled into a drill string comprising a first drill configured to drill at a first diameter. The method involves extending a wellbore with the first drill.

The method continues by removing the drill string section from the wellbore and removing the downhole probe from the drill string section. The method then inserts into a second drill string section having a bore of a second diameter different from the first diameter a second centralizer and the downhole probe. Again, the centralizer and downhole probe may be inserted into the second drill string section at the same time or at different times. The second centralizer extends between a wall of the bore of the second drill string section and the downhole probe and thereby mechanically couples the downhole probe to the second drill string section. The second centralizer supports the downhole probe centralized in the second drill string section. The second drill string section may then be coupled into a drill string comprising a second drill configured to drill at a second diameter. The method further extends the wellbore with the second drill. The method may further comprise extend the well bore using drill string sections of other diameters, each time adapting the downhole probe to the drill string section using a corresponding centralizer.

In some embodiments the first and second centralizers are each configured to provide longitudinal channels between the centralizer and the downhole probe and the method comprises flowing drilling fluid through the channels.

In some embodiments the downhole probe is supported by interchangeable axial supports in addition to the centralizer. The axial supports may, for example, comprise spiders. The method may involve interchanging an axial support dimensioned to engage a landing in the first drill string section for an axial support dimensioned to engage a landing in the second drill string section.

Another example aspect provides apparatus for use in subsurface drilling. The apparatus comprises a plurality of differently-sized tubular centralizers each having a central opening dimensioned to snugly receive a downhole probe and an outside profile. Each of the tubular centralizers is associated with a corresponding size of drill string section. The outside profile of each of the plurality of centralizers is configured to engage the bore wall of drill string sections of the corresponding size. The downhole probe may optionally be included as part of the apparatus. The apparatus may be provided in the form of a kit or set at a drilling site and applied to adapt a downhole probe to drill string sections of various diameters. Advantageously, in some embodiments this can be done without disassembling the downhole probe. The centralizers may, for example, include centralizers dimensioned to engage the bore wall of standard drill string sections. The drill string sections may have dimensions as specified, for example, by API Specification 7-1 (API Spec 7-1 *Specification for Rotary Drill Stem Elements, First Edition—Identical to ISO* 10424-1:2004, *Includes Addendum* 1 (2007), *Addendum* 2 (2009), *Addendum* 3 (2011), American Petroleum Institute, 2006 which is hereby incorporated herein by reference for all purposes). For example, the drill string sections may be of two or more outside diameters selected from: 4¾ inches, 6½ inches, 8 inches, 9½ inches and 11 inches. In some embodiments the drill string sections include drill string sections having larger diameters, such as 13 inches or 16 inches.

The apparatus may further comprise a plurality of differently-sized axial supports, each of the axial supports associated with one of the corresponding sizes of drill string section and being dimensioned to engage a landing in drill string sections of the corresponding size. In some embodiments the plurality of axial supports each comprises a spider having a hub, a rim and a plurality of spokes connecting the hub to the rim. The hubs of the spiders may be bored to receive a shaft extending from the downhole probe. In some embodiments the spiders and downhole probe are configured (e.g. with keys, splines, grooves, or other features of configuration such that the spiders are not free to rotate relative to the downhole probe.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
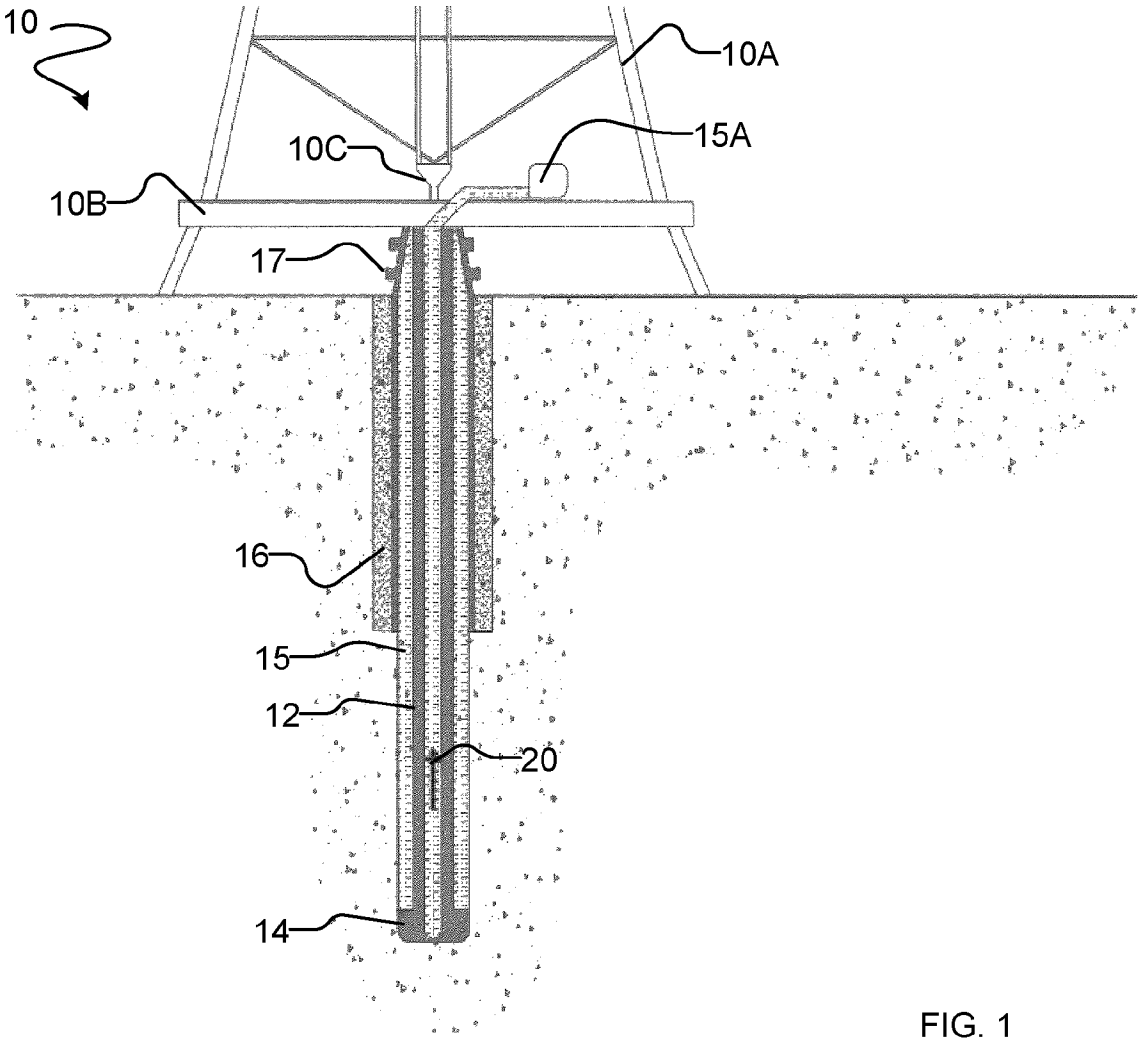
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Figure 2:
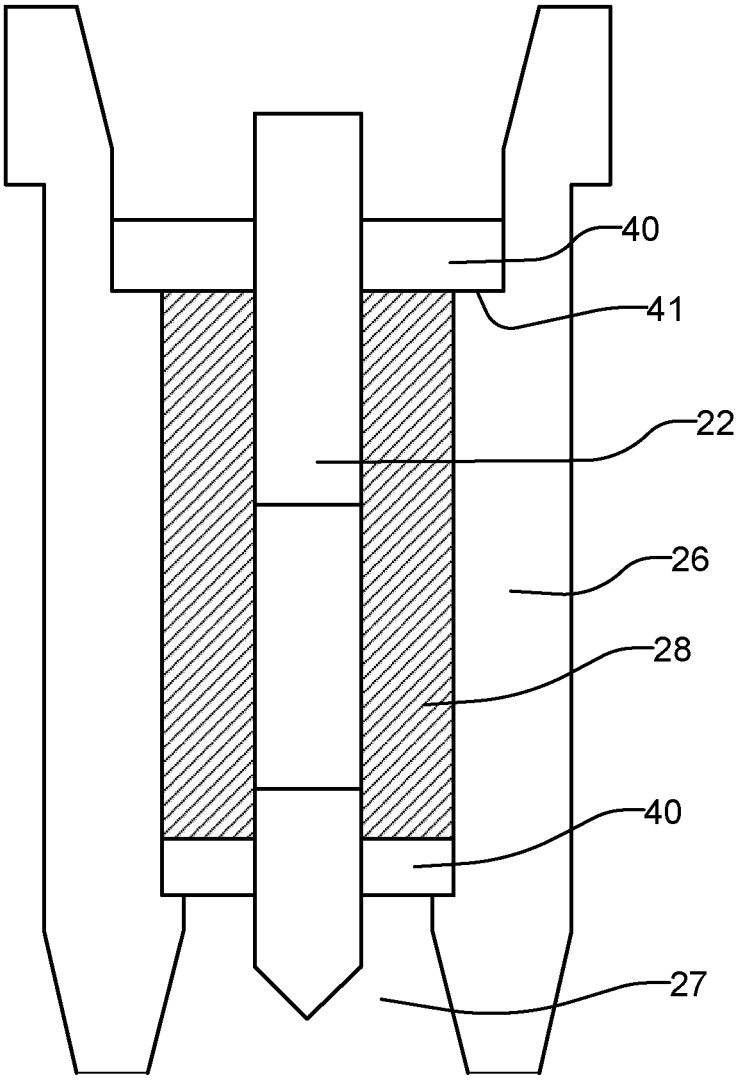
FIG. 2 shows a downhole probe supported in a section of drill string by a centralizer.

As shown in FIG. 2, a downhole probe 22 may be supported in a section 26 of drill string by a centralizer 28. One or more axial supports 40 may also be provided. Centralizer 28 prevents downhole probe 22 from moving radially in bore 27 of section 26 and axial supports 40 prevent downhole probe 22 from moving axially in bore 27. One or more of centralizer 28 and axial supports 40 may optionally be further configured to prevent or limit rotation of downhole probe 22 in bore 27.

Centralizer 28 is configured to provide one or more passages through which fluid can flow past downhole probe 22 in bore 27.

Centralizer 28 may be made from a range of materials from metals to plastics suitable for exposure to downhole conditions. Centralizer 28 may conveniently comprise a relatively lightweight material such a suitable plastic. Centralizer 28 may, for example, comprise a plastic extrusion. For example centralizer 28 may be made from a suitable thermoplastic such as a suitable grade of PEEK (Polyetheretherketone) or PET (Polyethylene terephthalate) plastic. Where centralizer 28 is made of plastic the plastic may be fiber-filled (e.g. with glass fibers) for enhanced erosion resistance, structural stability and strength.

Centralizer 28 may optionally comprise other materials, for example, suitable elastomeric polymers, rubber, aluminum or other metals.

The material of centralizer 28 should be capable of withstanding downhole conditions without degradation. The ideal material can withstand temperature of up to at least 150 C (preferably 175 C or 200 C or more), is chemically resistant or inert to any drilling fluid to which it will be exposed, does not absorb fluid to any significant degree and resists erosion by drilling fluid. In cases where centralizer 28 contacts metal of downhole probe 22 and/or bore 27 (e.g. where one or both of downhole probe 22 and bore 27 is uncoated) the material of centralizer 28 is preferably not harder than the metal of downhole probe 22 and/or section 26 that it contacts. Centralizer 28 should be stiff against deformations so that electronics package 22 is kept concentric within bore 27. The material characteristics of centralizer 28 may be uniform.

The material of centralizer 28 may also be selected for compatibility with sensors associated with electronics package 22. For example, where electronics package 22 includes a magnetometer, it is desirable that centralizer 28 be made of a non-magnetic material such as a suitable thermoplastic.

In cases where centralizer 28 is made of a relatively unyielding material, a layer of a vibration damping material such as rubber, an elastomer, a thermoplastic or the like may be provided between downhole probe 22 and centralizer 28 and/or between centralizer 28 and bore 27. The vibration damping material may assist in preventing 'pinging' (high frequency vibrations of downhole probe 22 resulting from shocks).

Centralizer 28 may be formed by extrusion, injection molding, casting, machining, or any other suitable process.

In some cases it is desirable to drill different parts of a wellbore to have different diameters. In such applications it can be desirable to use the same downhole probe (or downhole probes having the same dimensions) while drilling the different parts of the wellbore. Some embodiments of the invention provide sets of centralizers that are useful in such applications. For example, a set comprising a plurality of differently-dimensioned centralizers 28 may be provided. Each centralizer 28 in the set may be dimensioned to hold the same downhole probe 22. Different centralizers may be provided for use in drill string sections having bores of different inside diameters. The centralizers may be provided already inserted into drill string sections or not yet inserted into drill string sections. In some embodiments the set comprises drill string sections of different outside diameters that are adapted for receiving the downhole probe. For example, the drill string sections in the set may comprise landings which can provide axial support to a downhole probe.

The set may also comprise a plurality of axial supports dimensioned to support the downhole probe 22 axially in bores of drill string sections having different diameters. In some embodiments the set comprises a downhole probe and, for each of a plurality of sizes of drill string section: a centralizer and one or more spiders configured for attachment to the downhole probe. Each group of two or more spiders includes a plurality of spiders dimensioned for use in drill string sections of a given size.

Where such a set is provided, as drilling progresses and the outer diameter of components of the drill string is changed, the same downhole probe may be used with different centralizers and axial supports from the set in drill string sections having bores of different diameters.

Moving a downhole probe from being supported in a drill string section of one size into a drill string section of a different size may be easily performed at a well site by removing the electronics package from the first drill string section, changing a spider or other axial support device to a size appropriate for the second drill string section and inserting the electronics package into an appropriately-sized centralizer in the second drill string section.

For example, a set comprising: spiders or other axial support devices of different sizes and centralizers of different sizes may be provided in which the spiders and centralizers are dimensioned to support a given probe in the bores of drill collars of any of a number of different standard sizes. For example, the set may comprise a selection of centralizers that facilitate supporting the probe in drill collars having outside diameters such as two or more of: 4¾ inches, 6½ inches, 8 inches, 9½ inches and 11 inches. The drill collars may collectively include drill collars of two, three or more different bore diameters. The centralizers may, by way of non-limiting example, be dimensioned in length to support probes having lengths in the range of 2 to 20 meters.

In some embodiments the set comprises, for each of a plurality of different sizes of drill string section, a plurality of different sections of centralizer that may be used together to support a downhole probe of a desired length. By way of non-limiting example, two 3 meter long sections of centralizer may be provided for each of a plurality of different bore sizes. The centralizers may be used to support 6 meters of a downhole probe.

Figure 3B:
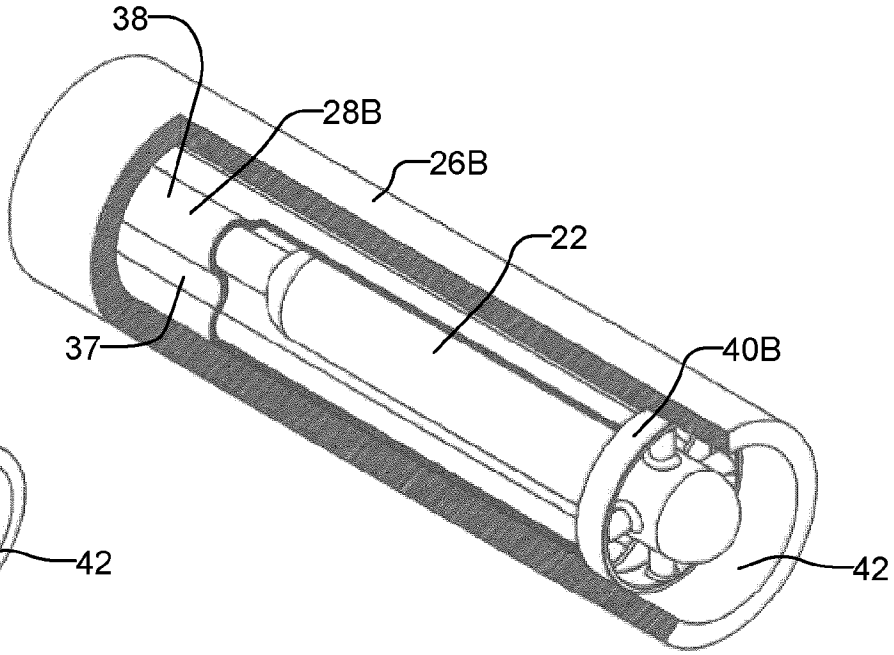
FIGS. 3A, 3B and 3C respectively show a downhole probe in three differently-dimensioned drill string sections.
Figure 3A:
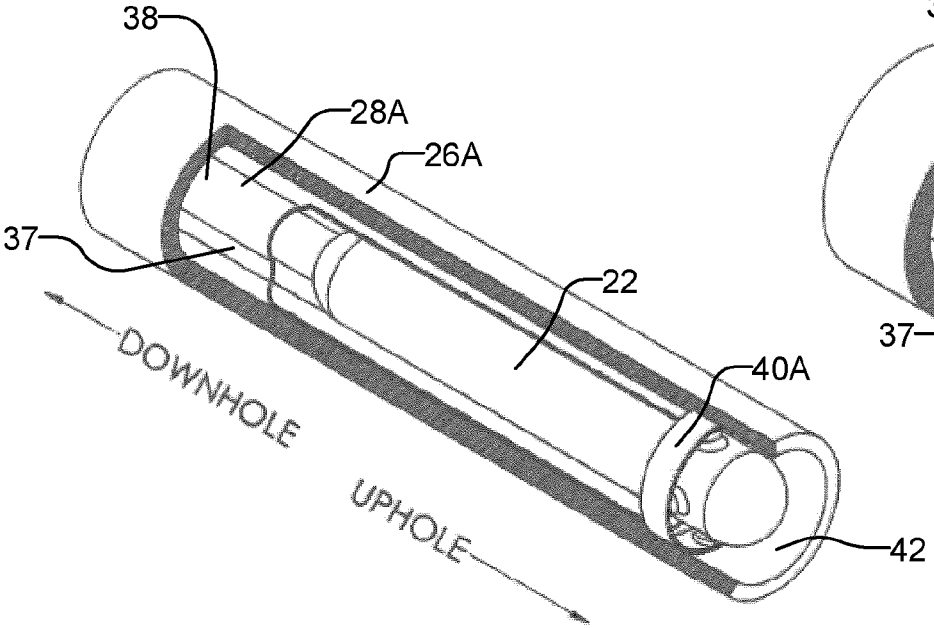
Figure 3C:
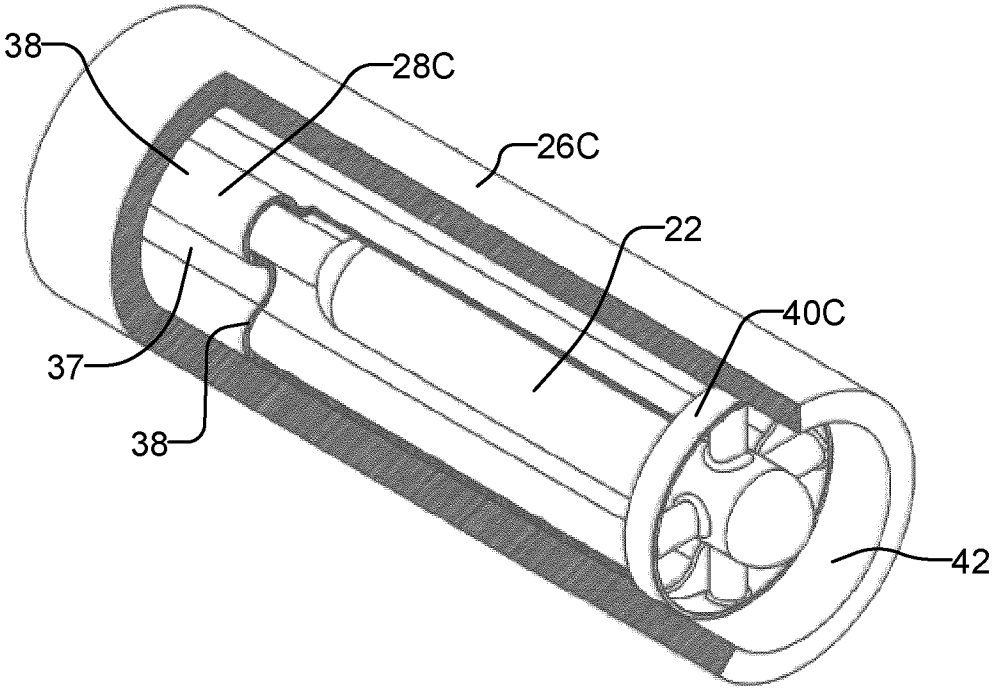

FIGS. 3A, 3B and 3C show a downhole probe 22 in three differently-dimensioned drill string sections 26A, 26B and 26C. In each case, downhole probe is supported by a centralizer. Centralizers 28A, 28B and 28C are respectively provided in drill string sections 26A, 26B and 26C.

Downhole probe 22 is additionally supported by a spider. Spiders 40A, 40B and 40C are respectively dimensioned to engage features in drill string sections 26A, 26B and 26C. For example, rims of spiders 40A, 40B and 40C may each be clamped against a landing in the bore of the corresponding drill string section 26A, 26B or 26C. The rims of spiders 40A, 40B and 40C may be held in place, for example, by externally-threaded ring nuts (not shown) which engage corresponding threads in surfaces 42.

Figure 4C:
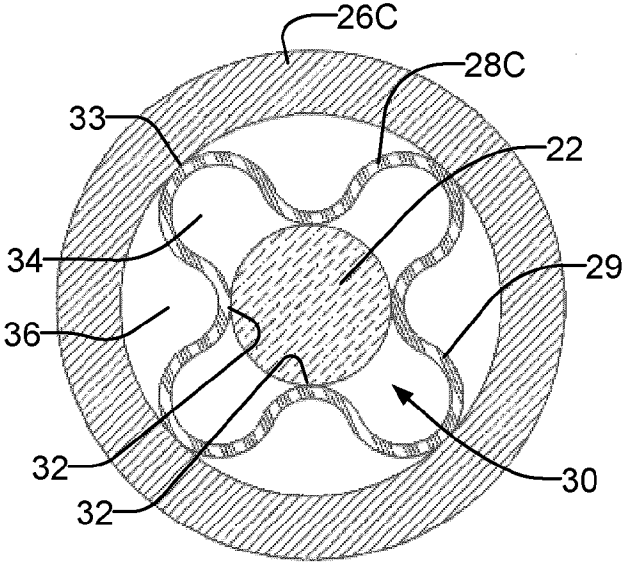
FIGS. 4A, 4B and 4C respectively show cross sections through drill string sections of different outside diameters in planes which pass through a downhole probe and a centralizer supporting the downhole probe.
Figure 4B:
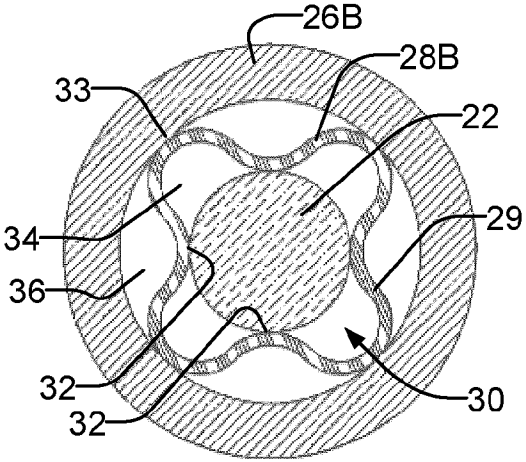
Figure 4A:
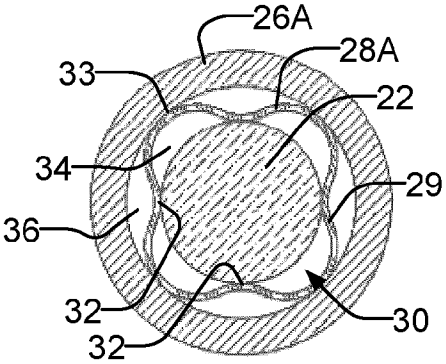

FIGS. 4A, 4B and 4C respectively show cross sections through drill string sections 26A, 26B and 26C in planes which pass through downhole probe 22. In this example, each of centralizers 28A, 28B and 28C has a similar construction.

In the illustrated embodiment, each of centralizers 28A, 28B, and 28C (collectively or generally 'centralizers 28') comprises a tubular body 29 having a bore 30 for receiving downhole probe 22 and formed to provide axially-extending inner support surfaces 32 for supporting downhole probe 22 and outer support surfaces 33 for bearing against the wall of bore 27 of a corresponding one of sections 26A, 26B and 26C. Each of these centralizers 28 divides the annular space surrounding downhole probe 22 into a number of axial channels. The axial channels include inner channels 34 defined between centralizer 28 and downhole probe 22 and outer channels 36 defined between centralizer 28 and the wall of section 26.

Centralizer 28 may be provided in one or more sections and may extend substantially continuously for any desired length along downhole probe 22. In some embodiments, centralizer 28 extends substantially the full length of downhole probe 22. In some embodiments, centralizer 28 extends to support downhole probe 22 substantially continuously along at least 60% or 70% or 80% of an unsupported portion of downhole probe 22 (e.g. a portion of downhole probe 22 extending from a point at which electronics package 22 is coupled to section 26 to an end of downhole probe 22). In some embodiments centralizer 28 engages substantially all of the unsupported portion of downhole probe 22. Here, 'substantially all' means at least 95%.

In the illustrated embodiment, inner support surfaces 32 are provided by the ends of inwardly-directed longitudinally-extending lobes 37 and outer support surfaces 33 are provided by the ends of outwardly-directed longitudinally-extending lobes 38 (See FIGS. 3A to 3C). The number of lobes may be varied. The illustrated embodiment has four lobes 37 and four lobes 38. However, other embodiments may have more or fewer lobes. For example, some alternative embodiments have three to eight lobes 38.

It is convenient but not mandatory to make the lobes of centralizer 28 symmetrical to one another. It is also convenient but not mandatory to make the cross-section of centralizer 28 mirror symmetrical about an axis passing through one of the lobes. It is convenient but not mandatory for lobes 37 and 38 to extend parallel to the longitudinal axis of centralizer 28. In the alternative, centralizer 28 may be formed so that lobes 37 and 38 are helical in form.

Centralizers 28 as shown in FIGS. 3A to 3C may be formed by extrusion, injection molding, casting, machining, or any other suitable process. Advantageously the wall thickness of each centralizer 28 can be substantially constant. This facilitates manufacture by extrusion. In the embodiment illustrated in FIGS. 3A to 3C, the lack of sharp corners reduces the likelihood of stress cracking, especially when a centralizer 28 has a constant or only slowly changing wall thickness. In an example embodiment, the wall of each centralizer 28 has a thickness in the range of 0.1 to 0.3 inches (2½ to 7½ mm). In a more specific example embodiment, the wall of centralizer 28 is made of a thermoplastic material (e.g. PET or PEEK) and has a thickness of about 0.2 inches (about 5 mm).

Each centralizer 28 is preferably sized to snuggly grip downhole probe 22. Preferably insertion of downhole probe 22 into any of centralizers 28A to 28C resiliently deforms the centralizer 28 such that the centralizer 28 grips the outside of downhole probe 22 firmly. Downhole probe 22 may be somewhat larger in diameter than the space between the innermost parts of centralizer 28 (at least when the centralizer 28 is inserted into the bore of a corresponding drill string section) to provide an interference fit between the downhole probe and centralizer 28. The size of the interference fit is an engineering detail but may, for example, be ½ mm or so (a few hundredths of an inch) for example.

It can be seen from FIGS. 4A to 4C that, in cross section, the tubular wall 29 of each centralizer 28 extends around downhole probe 22. Wall 29 is shaped to provide outwardly projecting lobes 38 that are outwardly convex and inwardly concave as well as inwardly-projecting lobes 37 that are inwardly convex and outwardly concave. In the illustrated embodiment, each outwardly projecting lobe 38 is between two neighbouring inwardly projecting lobes 37 and each inwardly projecting lobe 37 is between two neighbouring outwardly projecting lobes 38. The walls of centralizers 28 are sinuous and may be constant in thickness to form both inwardly projecting lobes 37 and outwardly projecting lobes 38.

In the illustrated embodiment, portions of the wall 29 of centralizer 28 bear against the outside of the downhole probe 22 and other portions of the wall 29 of centralizer 28 bear against the inner wall of the bore 27 of the corresponding section 26. As one travels around the circumference of each centralizer 28, centralizer 28 makes alternate contact with downhole probe 22 on the internal aspect of wall 29 of centralizer 28 and with section 26 on the external aspect of centralizer 28. Wall 29 of centralizer 28 zig zags back and forth between downhole probe 22 and the wall of bore 27 of the corresponding section 26. In the illustrated embodiment the parts of the wall 29 of centralizer 28 that extend between an area of the wall that contacts downhole probe 22 and a part of wall 29 that contacts section 26 are curved. These curved wall parts are preloaded such that centralizer 28 exerts a compressive force on downhole probe 22 and holds downhole probe 22 centralized in bore 27.

When section 26 experiences a lateral shock, centralizer 28 cushions the effect of the shock on downhole probe 22 and also prevents downhole probe 22 from moving too much away from the center of bore 27. After the shock has passed, centralizer 28 urges the downhole probe 22 back to a central location within bore 27. The parts of the wall 29 of centralizer 28 that extend between an area of the wall that contacts downhole probe 22 and an area of the wall that contacts section 26 can dissipate energy from shocks and vibrations into the drilling fluid that surrounds them. Furthermore, these wall sections are pre-loaded and exert restorative forces that act to return downhole probe 22 to its centralized location after it has been displaced.

As shown in FIGS. 4A to 4C, each centralizer 28 divides the annular space within bore 27 surrounding downhole probe 22 into a first plurality of inner channels 34 inside the wall 29 of centralizer 28 and a second plurality of outer channels 36 outside the wall 29 of centralizer 28. Each of inner channels 34 lies between two of outer channels 36 and is separated from the outer channels 36 by a part of the wall of centralizer 28. One advantage of this configuration is that the curved, pre-tensioned flexed parts of the wall tend to exert a restoring force that urges downhole probe 22 back to its equilibrium (centralized) position if, for any reason, downhole probe 22 is moved out of its equilibrium position. The presence of drilling fluid in channels 34 and 36 tends to damp motions of downhole probe 22 since transverse motion of downhole probe 22 results in motions of portions of the wall of centralizer 28 and these motions transfer energy into the fluid in channels 34 and 36. In addition, dynamics of the flow of fluid through channels 34 and 36 may assist in stabilizing centralizer 28 by carrying off energy dissipated into the fluid by centralizer 28.

The preloaded parts of wall 29 provide good mechanical coupling of the downhole probe 22 to the drill string section 26 in which the electronics package 22 is supported. Centralizer 28 may provide such coupling along the length of the downhole probe 22. This good coupling to the drill string section 26, which is typically very rigid, can increase the resonant frequencies of downhole probe 22, thereby making the downhole probe 22 more resistant to being damaged by high amplitude low frequency vibrations that typically accompany drilling operations.

Figure 5:
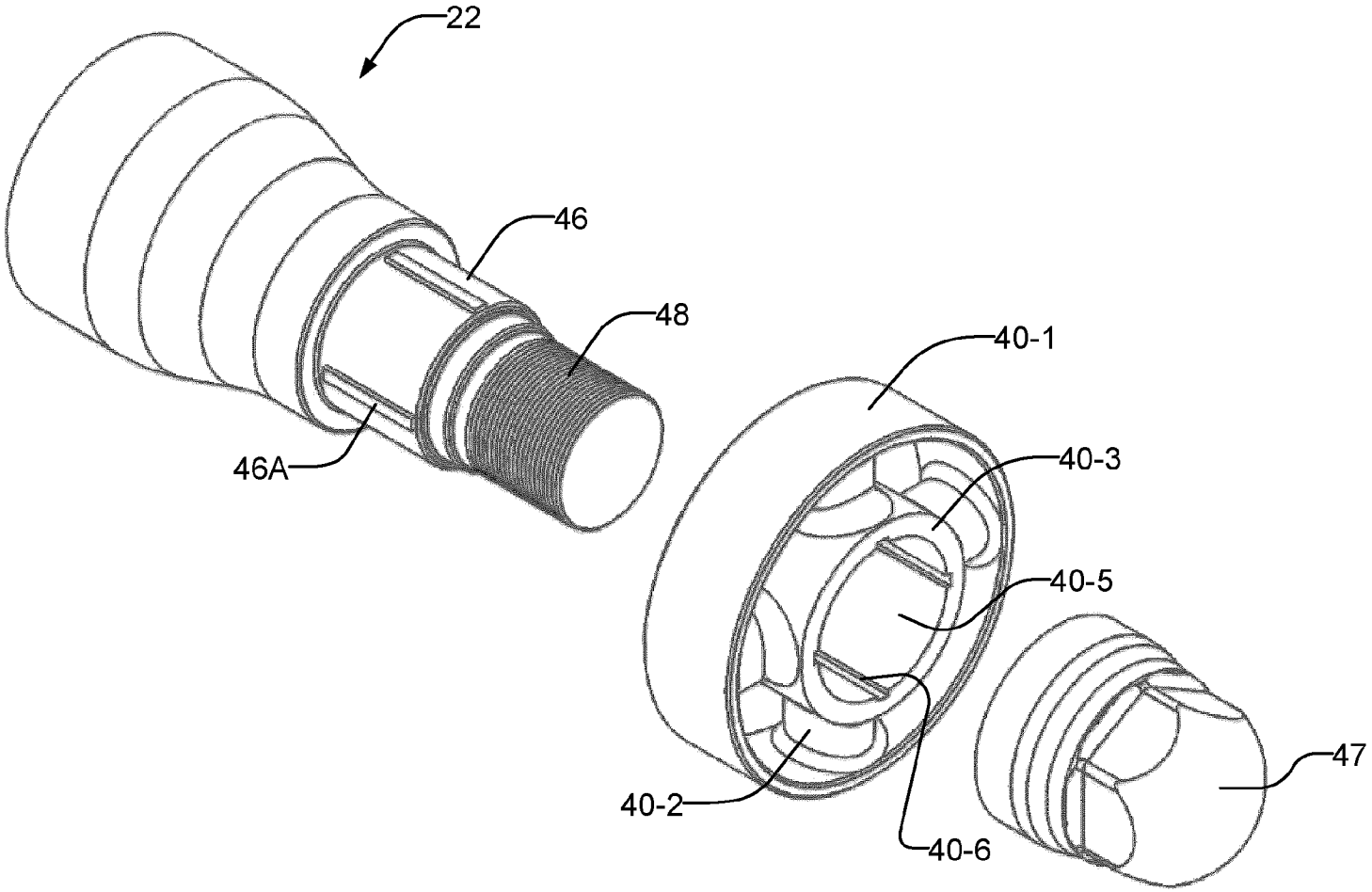
FIG. 5 illustrates an arrangement for removably coupling a spider or other support to a downhole probe.

Downhole probe 22 may be locked against axial movement within bores 27 in different sections 26 in any suitable manner. In the embodiment illustrated in FIGS. 3A to 3C, downhole probe is axially supported by an appropriately-dimensioned spider 40A, 40B or 40C (collectively or generally spiders 40). As shown in FIG. 5, each spider 40 has a rim 40-1 supported by arms 40-2 which extend to a hub 40-3 attached to downhole probe 22. Openings 40-4 between arms 40-2 provide space for the flow of drilling fluid past the spider 40.

Rim 40-1 is dimensioned to engage a landing ledge 41 (see e.g. FIG. 2) formed at the end of a counterbore within bore 27 in the corresponding section 26. Rim 40-1 may be clamped tightly against landing ledge 41 by a suitable nut or other clamping structure.

FIG. 5 illustrates one way to removably couple a spider 40 to a downhole probe 22. In the illustrated embodiment, downhole probe 22 comprises a shaft 46 dimensioned to engage a bore 40-5 in hub 40-3 of spider 40. A nut 47 engages threads 48 to secure spider 40 on shaft 46. In the illustrated embodiment, shaft 46 comprises splines 46A which engage corresponding grooves 40-6 in bore 40-5 to prevent rotation of spider 40 relative to shaft 46. An opposing end of downhole probe 22 (not shown in FIG. 5) may be similarly configured to support a spider 40.

Figure 5C:
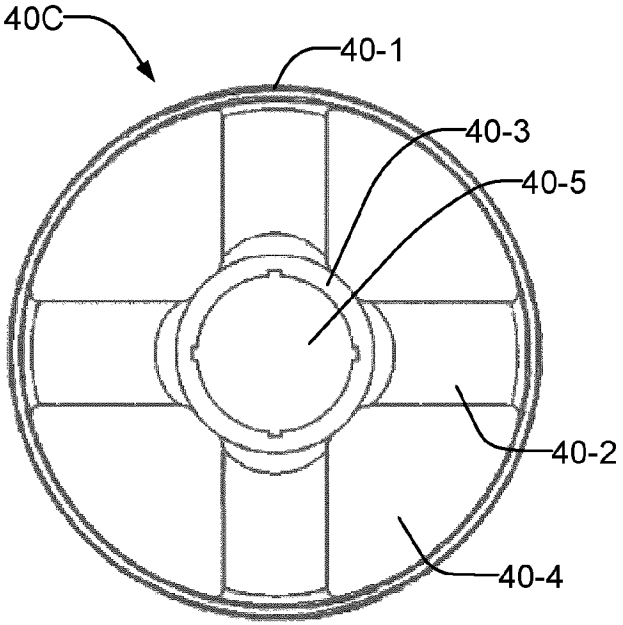
FIGS. 5A to 5C respectively show spiders of different sizes that may be provided in a set for adapting downhole probe for use in different-sized drill string sections.
Figure 5B:
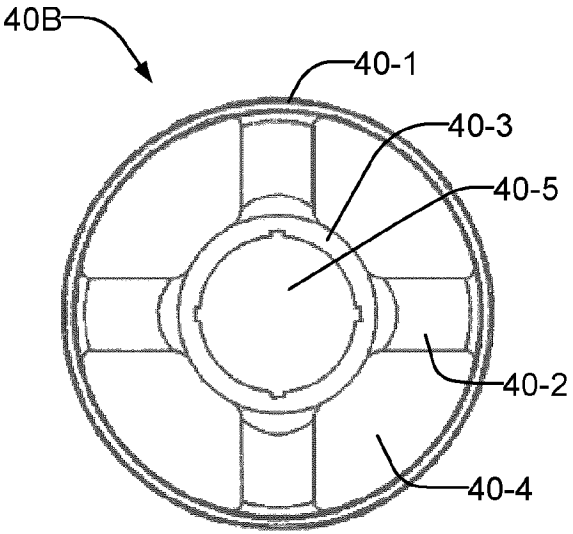
Figure 5A:
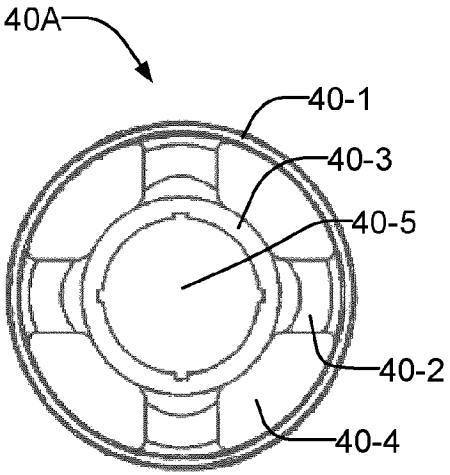

FIGS. 5A to 5C respectively show spiders 40A, 40B and 40C that may be provided in a set for adapting downhole probe 22 for use in different-sized drill string sections. The bore 40-5 of each of spiders 40A to 40C may be the same size such that spiders 40A to 40C can be interchangeably affixed to shaft 46. Rims 40-1 of spiders 40A, 40B and 40C have different diameters.

In some embodiments, centralizer 28 extends from spider 40 or other longitudinal support system for electronics package 22 continuously to the opposing end of downhole probe 22. In other embodiments one or more sections of centralizer 28 extend to grip downhole probe 22 over at least 70% or at least 80% or at least 90% or at least 95% of a distance from the longitudinal support to the opposing end of downhole probe 22.

In some embodiments downhole probe 22 has a fixed rotational orientation relative to section 26. For example, in some embodiments spider 40 is configured to non-rotationally engage a corresponding section 26, for example by way of a key, splines, shaping of the face or edge of rim 40-1 that engages corresponding shaping within bore 27 or the like. In some embodiments where downhole probe 22 is supported by two spiders 40, one of the spiders is configured to be anchored axially in bore 27 of a corresponding section 26 (e.g. configured to have a diameter to engage a landing in bore 27) and the other one of the spiders is configured to be coupled non-rotationally to the corresponding section 26 (e.g. configured with one or more keys, grooves, splines or the like arranged to engage corresponding features within bore 27). A set of interchangeable spiders may include a pair of spiders, one configured as an axial anchor and one configured as a rotational anchor for use with each of a plurality of different sizes of drill string section.

Figure 6:
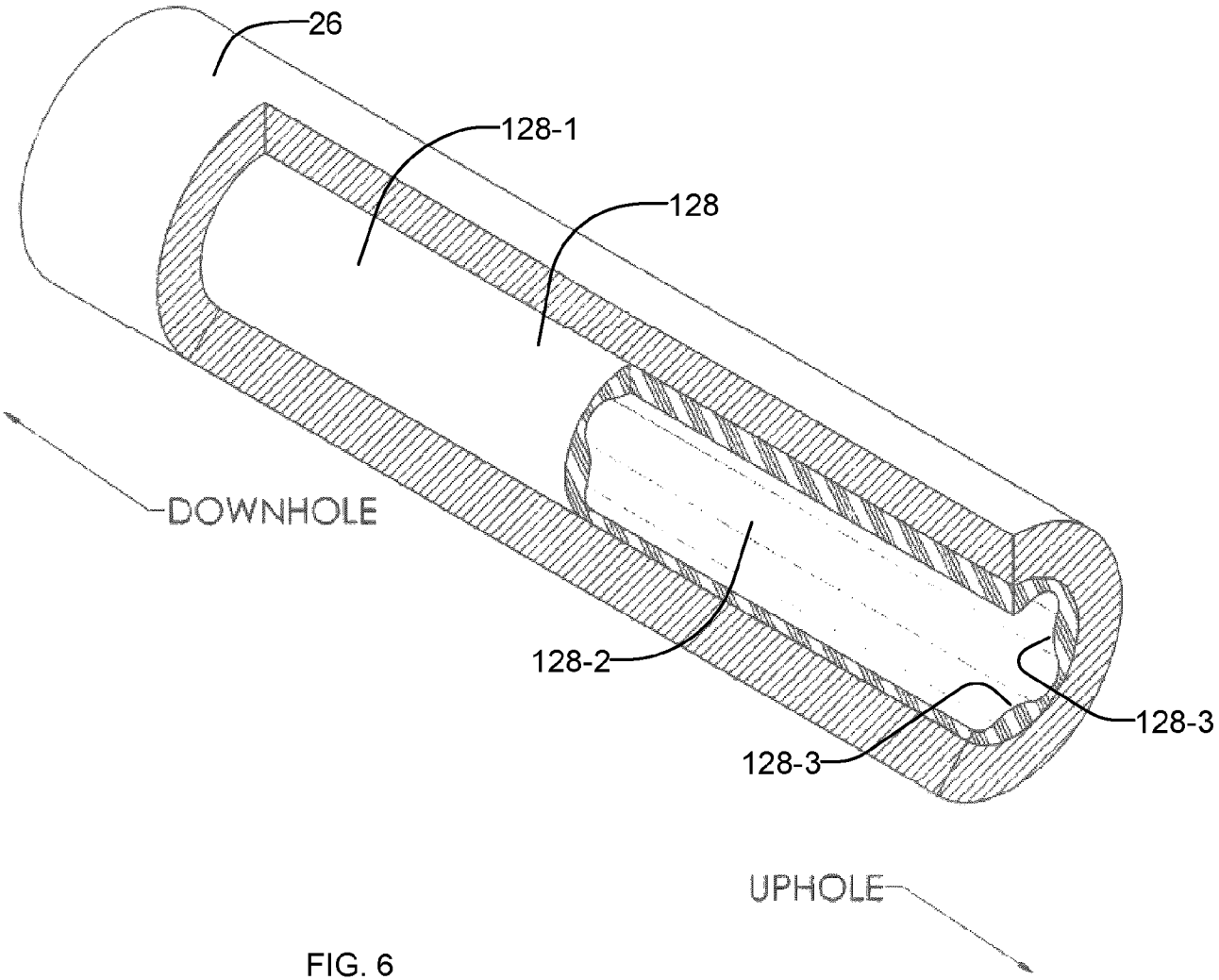
FIG. 6 shows an example centralizer of an alternative type that may be provided in a set for adapting a downhole probe to be supported in the bore of a drill string section.

The centralizers 28 illustrated in FIGS. 3A to 3C and 4A to 4C are only one example. Other interchangeable centralizers may be provided instead of or in addition to centralizers of the type shown in FIGS. 3A to 3C. For example, FIG. 6 shows an example centralizer 128. Centralizer 128 has a cylindrical outer surface 128-1 and a non-round bore 128-2 shaped to provide inwardly-projecting ridges 128-3 dimensioned to support a downhole probe. A set may include or consist of centralizers like centralizer 128 having different outside diameters for removable insertion into drill string sections of different diameters.

In some embodiments, means may be provided to prevent a centralizer from moving axially relative to a probe or a section of drill string. In some embodiments, means may be provided to prevent a centralizer from rotating relative to a probe or a drill string section.

A landing edge may be provided on the interior surface of a section of drill string. The landing edge may be dimensioned to engage with a centralizer, thereby preventing the centralizer from moving axially past the landing edge. Features may be provided on the landing edge to engage with the centralizer, thereby preventing the centralizer from rotating relative to the landing edge (and the section of drill string). For example, grooves may be provided on the landing edge dimensioned to engage with wall 29 of centralizer 28 or ridges or keys or the like may be provided on or near the landing edge to engage with corresponding longitudinally extending slots or grooves in a centralizer 28. In some embodiments, the landing edge is provided by a ring that is press-fit, pinned, bolted, or otherwise affixed within the bore of a section of drill string. In some embodiments the landing edge is located to receive a downhole end of the centralizer.

In some embodiments, means may be provided to prevent a probe from moving axially relative to a centralizer or a section of drill string. In some embodiments, means may be provided to prevent a probe from rotating relative to a centralizer or a drill string section.

Figure 7:
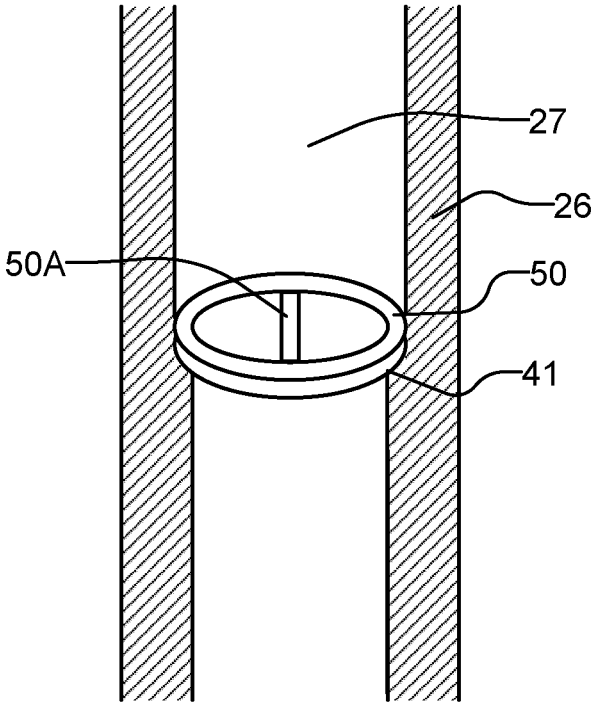
FIG. 7 is a schematic view of a ring within a drill string section.

FIG. 7 shows a ring 50 which may be used to prevent axial and rotational movement of a probe (not shown). Ring 50 is dimensioned to engage landing edge 41 formed at the end of a counterbore within bore 27 of the section 26.

Ring 50 may have one or more features 50A. Features 50A may comprise, for example, longitudinally-extending slots, keyways, keys, ridges, or the like. When a probe is inserted within bore 27, corresponding features on the probe engage features 50A such that the probe cannot rotate relative to ring 50. If ring 50 is prevented from rotating relative to section 26, then the probe will similarly be prevented from rotating relative to section 26. In some preferred embodiments, features 50A and the corresponding features on the probe are asymmetrical such that the probe can only engage features 50A when the probe has one specific rotational alignment within section 26. Thus the probe can repeatably be inserted into the section 26 to engage features 50A and removed from the section 26 and the probe will have a fixed rotational alignment within the section 26 each time.

In some embodiments, ring 50 may be dimensioned such that it is a "tight fit" within bore 27 of section 26. The force of friction between the interior walls of section 26 and ring 50 may be sufficient to prevent rotation of ring 50 relative to section 26. In some embodiments, ring 50 may be prevented from rotating relative to section 26 by other means, for example by being pinned or bolted in place, engaging with threads along the interior wall of section 26 or the like.

Interpretation of Terms

Unless the context clearly requires otherwise, throughout the description and the

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A method for drilling wellbores, the method comprising:

inserting into a first drill string section having a bore of a first diameter a first centralizer and a downhole probe, the first centralizer extending between a wall of the bore of the first drill string section and the downhole probe and thereby mechanically coupling the downhole probe to the first drill string section and supporting the downhole probe centralized in the first drill string section;

coupling the drill string section to a drill string comprising a first drill configured to drill at a third diameter and extending a wellbore with the first drill;

removing the drill string section from the wellbore and removing the downhole probe from the drill string section;

inserting into a second drill string section having a bore of a second diameter different from the first diameter a second centralizer and the downhole probe, the second centralizer extending between a wall of the bore of the second drill string section and the downhole probe and thereby mechanically coupling the downhole probe to the second drill string section and supporting the downhole probe centralized in the second drill string section;

coupling the second drill string section to a drill string comprising a second drill configured to drill at a fourth diameter and further extending the wellbore with the second drill; and inserting the first centralizer into the first drill string section before inserting the downhole probe into the first centralizer;

wherein:

inserting the downhole probe into the first drill string section comprises engaging a first axial support coupled to the downhole probe with a first landing in the first drill string section;

the method comprises, before inserting the downhole probe into the second drill string section, interchanging the first axial support for a second axial support dimensioned to engage a second landing in the second drill string section; and inserting the downhole probe into the second drill string section comprises engaging the second axial support with the second landing.

2. A method for drilling wellbores, the method comprising:

inserting into a first drill string section having a bore of a first diameter a first centralizer and a downhole probe, the first centralizer extending between a wall of the bore of the first drill string section and the downhole probe and thereby mechanically coupling the downhole probe to the first drill string section and supporting the downhole probe centralized in the first drill string section;

coupling the drill string section to a drill string comprising a first drill configured to drill at a third diameter and extending a wellbore with the first drill;

removing the drill string section from the wellbore and removing the downhole probe from the drill string section;

inserting into a second drill string section having a bore of a second diameter different from the first diameter a second centralizer and the downhole probe, the second centralizer extending between a wall of the bore of the second drill string section and the downhole probe and thereby mechanically coupling the downhole probe to the second drill string section and supporting the downhole probe centralized in the second drill string section; and coupling the second drill string section to a drill string comprising a second drill configured to drill at a fourth diameter and further extending the wellbore with the second drill;

wherein:

inserting the downhole probe into the first drill string section comprises engaging a first axial support coupled to the downhole probe with a first landing in the first drill string section;

the method comprises, before inserting the downhole probe into the second drill string section, interchanging the first axial support for a second axial support dimensioned to engage a second landing in the second drill string section;

inserting the downhole probe into the second drill string section comprises engaging the second axial support with the second landing; and the first and second centralizers are each configured to provide longitudinal channels between the centralizer and the downhole probe and the method comprises flowing drilling fluid through the channels.

3. A method for drilling wellbores, the method comprising:

inserting into a first drill string section having a bore of a first diameter a first centralizer and a downhole probe, the first centralizer extending between a wall of the bore of the first drill string section and the downhole probe and thereby mechanically coupling the downhole probe to the first drill string section and supporting the downhole probe centralized in the first drill string section;

coupling the drill string section to a drill string comprising a first drill configured to drill at a third diameter and extending a wellbore with the first drill;

removing the drill string section from the wellbore and removing the downhole probe from the drill string section;

inserting into a second drill string section having a bore of a second diameter different from the first diameter a second centralizer and the downhole probe, the second centralizer extending between a wall of the bore of the second drill string section and the downhole probe and thereby mechanically coupling the downhole probe to the second drill string section and supporting the downhole probe centralized in the second drill string section; and coupling the second drill string section to a drill string comprising a second drill configured to drill at a fourth diameter and further extending the wellbore with the second drill;

wherein:

inserting the downhole probe into the first drill string section comprises engaging a first axial support coupled to the downhole probe with a first landing in the first drill string section;

the method comprises, before inserting the downhole probe into the second drill string section, interchanging the first axial support for a second axial support dimensioned to engage a second landing in the second drill string section;

inserting the downhole probe into the second drill string section comprises engaging the second axial support with the second landing;

the first and second axial supports respectively comprise first and second spiders having different outside diameters and each having a bore dimensioned to fit onto a shaft projecting axially from the downhole probe; and interchanging the first axial support for a second axial support comprises sliding the first spider off of the shaft and sliding the second spider onto the shaft.

4. Apparatus for use in subsurface drilling, the apparatus comprising:

a downhole probe;

a plurality of differently-sized tubular centralizers each having a central opening dimensioned to snugly receive the downhole probe and an outside profile, each of the tubular centralizers associated with a corresponding size of drill string section wherein the outside profile of each of the plurality of centralizers is configured to engage the bore wall of drill string sections of the corresponding size; and a plurality of differently-sized axial supports, each of the axial supports associated with one of the corresponding sizes of drill string section and being dimensioned to engage a landing in drill string sections of the corresponding size;

wherein the plurality of axial supports each comprises a spider having a hub, a rim and a plurality of spokes connecting the hub to the rim, the hubs of the spiders being bored to receive a shaft extending from the downhole probe.

5. Apparatus according to claim 4 wherein the centralizers include centralizers dimensioned to engage the bore wall of standard drill string sections of two or more outside diameters selected from: 4¾ inches (12 cm), 6½ inches (16½ cm), 8 inches (20.3 cm), 9½ inches (24 cm) and 11 inches (28 cm).

6. Apparatus according to claim 4 wherein the centralizers include a plurality of centralizers wherein each of the plurality of centralizers is dimensioned to engage the bore wall of a drill string section having a different inside diameter and the inside diameters correspond to insider diameters as specified for drill collars conforming to API specification 7-1.

7. A method according to claim 3 wherein the first and second spiders engage the shaft non-rotationally.

8. Apparatus according to claim 4 wherein the tubular centralizers are each made of a non-magnetic material.

9. Apparatus according to claim 4 wherein the tubular centralizers are each made of a thermoplastic.

10. Apparatus according to claim 9 wherein the thermoplastic comprises a fiber-filled thermoplastic.

11. Apparatus according to claim 4 wherein the plurality of tubular centralizers are stiff.

12. Apparatus according to claim 4 wherein each of the plurality of tubular centralizers is dimensioned to extend along substantially the full length of the downhole probe.

13. Apparatus according to claim 12 wherein the downhole probe has a length in the range of 2 to 20 meters.

14. Apparatus according to claim 12 wherein the centralizers include centralizers dimensioned to engage the bore wall of standard drill string sections of two or more outside diameters selected from: 4¾ inches (12 cm), 6½ inches (16½ cm), 8 inches (20.3 cm), 9½ inches (24 cm) and 11 inches (28 cm).

15. Apparatus according to claim 12 wherein the centralizers include a plurality of centralizers wherein each of the plurality of centralizers is dimensioned to engage the bore wall of a drill string section having a different inside diameter and the inside diameters correspond to insider diameters as specified for drill collars conforming to API specification 7-1.

16. Apparatus according to claim 12 wherein the plurality of axial supports each comprises a spider having a hub, a rim and a plurality of spokes connecting the hub to the rim, the hubs of the spiders being bored to receive a shaft extending from the downhole probe.

17. Apparatus according to claim 12 wherein the tubular centralizers are each made of a non-magnetic material.

18. Apparatus according to claim 12 wherein the tubular centralizers are each made of a thermoplastic.

19. Apparatus according to claim 18 wherein the thermoplastic comprises a fiber-filled thermoplastic.

20. Apparatus according to claim 12 wherein the plurality of tubular centralizers are stiff.

21. Apparatus according to claim 12 wherein each of the plurality of tubular centralizers is formed to provide axially-extending inner support surfaces for supporting the downhole probe and to divide an annular space surrounding the downhole probe in a corresponding one of the drill string sections into a first plurality of axial channels defined between the centralizer and the downhole probe.

22. Apparatus according to claim 12 wherein the downhole probe has a length in the range of 2 to 20 meters.

23. Apparatus according to claim 12 wherein each of the plurality of tubular centralizers is resiliently deformable to receive the downhole probe in the central opening.

24. Apparatus according to claim 12 wherein the outside profile of each of the plurality of tubular centralizers is cylindrical and dimensioned to be slidably insertable into the bore of the corresponding drill string section.

25. Apparatus according to claim 12 comprising, for each of the plurality of tubular centralizers a corresponding drill string section dimensioned to receive the tubular centralizer.

26. Apparatus according to claim 25 wherein each of the drill string sections comprises a landing for supporting the downhole probe.

27. Apparatus according to claim 4 wherein the outside profile of each of the plurality of tubular centralizers is cylindrical and dimensioned to be slidably insertable into the bore of the corresponding drill string section.

28. Apparatus according to claim 4 comprising, for each of the plurality of tubular centralizers a corresponding drill string section dimensioned to receive the tubular centralizer.

29. Apparatus according to claim 28 wherein each of the drill string sections comprises a landing for supporting the downhole probe.

30. Apparatus for use in subsurface drilling, the apparatus comprising:

a downhole probe;

a plurality of differently-sized tubular centralizers each having a central opening dimensioned to snugly receive the downhole probe and an outside profile, each of the tubular centralizers associated with a corresponding size of drill string section wherein the outside profile of each of the plurality of centralizers is configured to engage the bore wall of drill string sections of the corresponding size; and a plurality of differently-sized axial supports, each of the axial supports associated with one of the corresponding sizes of drill string section and being dimensioned to engage a landing in drill string sections of the corresponding size;

wherein each of the plurality of tubular centralizers is formed to provide axially-extending inner support surfaces for supporting the downhole probe and to divide an annular space surrounding the downhole probe in a corresponding one of the drill string sections into a first plurality of axial channels defined between the centralizer and the downhole probe.

31. Apparatus according to claim 30 wherein the plurality of tubular centralizers are further configured to provide a second plurality of axially-extending channels defined between the outside profile of the centralizers and the bore wall of the corresponding drill string section.

32. Apparatus for use in subsurface drilling, the apparatus comprising:

a downhole probe;

a plurality of differently-sized tubular centralizers each having a central opening dimensioned to snugly receive the downhole probe and an outside profile, each of the tubular centralizers associated with a corresponding size of drill string section wherein the outside profile of each of the plurality of centralizers is configured to engage the bore wall of drill string sections of the corresponding size; and a plurality of differently-sized axial supports, each of the axial supports associated with one of the corresponding sizes of drill string section and being dimensioned to engage a landing in drill string sections of the corresponding size;

wherein each of the plurality of tubular centralizers is resiliently deformable to receive the downhole probe in the central opening.

33. A method according to claim 3 wherein the first and second centralizers are dimensioned to extend along substantially the full length of the downhole probe.

34. A method according to claim 33 comprising inserting the first centralizer into the first drill string section before inserting the downhole probe into the first centralizer.

35. A method according to claim 33 wherein the first and second centralizers are each configured to provide longitudinal channels between the centralizer and the downhole probe and the method comprises flowing drilling fluid through the channels.

36. A method according to claim 33 wherein:

the first and second axial supports respectively comprise first and second spiders having different outside diameters and each having a bore dimensioned to fit onto a shaft projecting axially from the downhole probe; and interchanging the first axial support for a second axial support comprises sliding the first spider off of the shaft and sliding the second spider onto the shaft.

37. A method according to claim 36 wherein the first and second spiders engage the shaft non-rotationally.

38. Apparatus for use in subsurface drilling, the apparatus comprising:

a downhole probe;

a plurality of differently-sized tubular centralizers each having a central opening dimensioned to snugly receive the downhole probe and an outside profile, each of the tubular centralizers associated with a corresponding size of drill string section wherein the outside profile of each of the plurality of centralizers is configured to engage the bore wall of drill string sections of the corresponding size;

wherein each of the plurality of tubular centralizers is dimensioned to extend along substantially the full length of the downhole probe;

each of the plurality of tubular centralizers is formed to provide axially-extending inner support surfaces for supporting the downhole probe and to divide an annular space surrounding the downhole probe in a corresponding one of the drill string sections into a first plurality of axial channels defined between the centralizer and the downhole probe; and, the plurality of tubular centralizers are further configured to provide a second plurality of axially-extending channels defined between the outside profile of the centralizers and the bore wall of the corresponding drill string section.

* * * * *